US011702836B2

(12) United States Patent
Shiohara et al.

(10) Patent No.: US 11,702,836 B2
(45) Date of Patent: Jul. 18, 2023

(54) STRUCTURE FOR JOINING COLUMN AND BEAM FRAME AND SHEAR WALL

(71) Applicants: THE UNIVERSITY OF TOKYO, Tokyo (JP); Masaomi Teshigawara, Tokyo (JP); Yoshio Inoue, Tokyo (JP); SANKO TECHONO CO., LTD., Chiba (JP); KSE network Co., Ltd., Tokyo (JP); OHMOTO GUMI Co., Ltd., Okayama (JP); ssd Corporation, Chiba (JP); Marukawa Associates Architects and Engineers, Okayama (JP)

(72) Inventors: Hitoshi Shiohara, Tokyo (JP); Masaomi Teshigawara, Tokyo (JP); Yoshio Inoue, Tokyo (JP); Takashi Sato, Chiba (JP); Yasue Yagisawa, Chiba (JP); Kenji Yokota, Tokyo (JP); Syunichiro Shishido, Chiba (JP); Koji Oka, Okayama (JP); Masaki Yamaguchi, Okayama (JP)

(73) Assignees: THE UNIVERSITY OF TOKYO, Tokyo (JP); Masaomi Teshigawara, Tokyo (JP); Yoshio Inoue, Tokyo (JP); SANKO TECHONO CO., LTD., Chiba (JP); KSE NETWORK CO., LTD., Tokyo (JP); OHMOTO GUMI CO., LTD., Okayama (JP); SSD CORPORATION, Chiba (JP); MARUKAWA ASSOCIATES ARCHITECTS AND ENGINEERS, Okayama (JP)

( * ) Notice: Subject to any disclaimer, the term of this patent is extended or adjusted under 35 U.S.C. 154(b) by 0 days.

(21) Appl. No.: 17/731,739

(22) Filed: Apr. 28, 2022

(65) Prior Publication Data

US 2023/0003013 A1 Jan. 5, 2023

(30) Foreign Application Priority Data

Jul. 1, 2021 (JP) ..... 2021-109786

(51) Int. Cl.

| | |
|---|---|
| ***E04B 1/41*** | (2006.01) |
| ***E04B 1/20*** | (2006.01) |
| ***E04B 2/84*** | (2006.01) |

(52) U.S. Cl.

CPC ..... *E04B 1/4157* (2013.01); *E04B 1/20* (2013.01); *E04B 2/84* (2013.01)

(58) Field of Classification Search

CPC . E04B 1/20; E04B 1/4157; E04B 2/34; E04B 2/562; E04H 9/02

See application file for complete search history.

(56) References Cited

FOREIGN PATENT DOCUMENTS

| | | | |
|---|---|---|---|
| JP | 2000-226938 | A | 8/2000 |
| JP | 2001-329699 | A | 11/2001 |

(Continued)

OTHER PUBLICATIONS

OEE work product: Decision to Grant a Patent, dated Oct. 4, 2022 in corresponding OEE Japanese Patent Application No. 2021-109786A (3 pages) (2 pages English Translation).

*Primary Examiner* — Christine T Cajilig
(74) *Attorney, Agent, or Firm* — Staas & Halsey LLP

(57) ABSTRACT

In between a shear wall of a reinforced concrete structure disposed in a column and beam frame of a reinforced concrete structure and the frame, transmission capability of a shear force between is enhanced from a stage which a relative deformation occurs among between the frame and the shear wall. Plate is disposed between an inner peripheral surface of a frame and an outer peripheral surface of a shear wall, integrated with any one of the frame and the shear wall, and continuous in a longitudinal direction and in a height direction of the shear wall and penetrate the plate in a (Continued)

thickness direction. The anchors are dispersedly in the longitudinal direction and in the height direction of the shear wall.

6 Claims, 5 Drawing Sheets

(56) References Cited

FOREIGN PATENT DOCUMENTS

| | | | | | |
|---|---|---|---|---|---|
| JP | 2002-285708 | A | | 10/2002 | |
| JP | 4799703 | B1 | * | 10/2011 | |
| JP | 5079640 | B2 | | 11/2012 | |
| JP | 5331268 | B1 | * | 10/2013 | ..... E04B 1/483 |
| JP | 2016-102400 | A | | 6/2016 | |
| JP | 2016-142021 | A | | 8/2016 | |
| JP | 2017-110452 | A | | 6/2017 | |
| JP | 2018-076677 | A | | 5/2018 | |
| JP | 2019-190079 | A | | 10/2019 | |
| JP | 2021-71034 | A | | 5/2021 | |
| JP | 7026294 | A | | 2/2022 | |
| JP | 7157854 | A | | 10/2022 | |
| WO | WO-2014006780 | A1 | * | 1/2014 | ..... E04B 1/483 |

* cited by examiner

STRUCTURE FOR JOINING COLUMN AND BEAM FRAME AND SHEAR WALL

CROSS-REFERENCE TO RELATED APPLICATIONS

This application is based upon and claims the benefit of priority of the prior Japanese Patent Application No. 2021-109786, filed Jul. 1, 2021, in the Japanese Patent Office, the entire contents of which are incorporated herein by reference.

BACKGROUND

1. Technical Field

The present invention relates to a structure for joining a column and beam frame and a shear wall in which a frame of a column and a beam of a reinforced concrete structure is joined with a shear wall of a reinforced concrete structure disposed in a structure plane of the frame using anchors.

2. Related Art

When a shear wall of a reinforced concrete structure is disposed in a structure plane of a frame of a column and a beam of a reinforced concrete structure, and the shear wall is integrally joined with the frame, there has been a method in which a frame material made of steel is disposed in a space ensured between an inner peripheral surface of the frame and an outer peripheral surface of the shear wall, and the frame material is fixed to each of the frame and the shear wall using anchors (see Patent Literatures 1 to 3).

In Patent Literature 1, especially, a bonding strength and a friction force generated in a grout material filled in spaces ensured between the frame material and the frame and between the frame material and the shear wall are used, thereby intending to transmit most of the shear force between the frame and the shear wall (paragraph 0020). Consequently, an effect of reducing the number of the anchors disposed to extend between the frame and the shear wall is obtained (paragraph 0021).

However, two types of anchors, the anchor that penetrates the frame material and is fixed to the frame and the anchor that is secured to the inner peripheral surface of the frame material and fixed to the shear wall, are required. Therefore, interposing the filler is not necessarily an efficient method.

In contrast, there has been a method in which a plate is interposed between a frame and a shear wall, and an anchor penetrates the plate and is fixed to both the frame and the shear wall (see Patent Literature 4). In this method, in the whole length of the anchor, a section buried in the frame and a section buried in the shear wall are restrained by the frame and the shear wall, respectively. Therefore, in a deformation (inter-story deformation) in a structure plane of the frame, that is, in a relative deformation between the frame and the shear wall, the respective buried sections try to behave integrally with the frame and the shear wall.

Patent Literature 1: JP-A-2002-285708 (paragraphs 0018 to 0026, FIG. 1 to FIG. 3)

Patent Literature 2: JP-A-2018-76677 (paragraphs 0019 to 0038, FIG. 1 to FIG. 3)

Patent Literature 3: JP-A-2000-226938 (paragraphs 0010 to 0013, FIG. 1 to FIG. 4)

Patent Literature 4: JP-A-2016-142021 (claim 1, paragraphs 0029 to 0072, FIG. 1 to FIG. 5)

The plate of Patent Literature 4 tries to behave integrally with the shear wall in the relative deformation due to an anchor reinforcement (stud) that is disposed to protrude on the shear wall side and buried in the shear wall (claim 1, paragraph 0031). Here, in the anchor, while the section buried in the frame and the section buried in the shear wall are restrained by the frame and the shear wall as described above, the section inserted through the plate is not locked to the plate (paragraph 0033), and not restrained. Therefore, a shear force concentratedly acts to the section inserted through the plate of the anchor.

Consequently, since the shear force concentratedly acts to the section not fixed to any of the frame or the shear wall in the relative deformation alternately in positive and negative directions, it is considered that the anchor is easily broken. Especially, since the anchors are not dispersedly disposed in a longitudinal direction of the shear wall (claim 1, FIG. 1, FIG. 7), it is not allowed to divide the shear force to the plurality of anchors via the plate, and the load per anchor easily becomes excessive.

In Patent Literature 4, since a void (clearance) is ensured between a peripheral surface of the anchor and an inner peripheral surface of a through-hole of the plate (paragraph 0033), the shear force is not transmitted to the anchor via the plate in an early stage in which a relative deformation exceeding the void between the inner peripheral surface of the through-hole provided to the plate and the peripheral surface of the anchor is caused.

Based on the background as described above, the present invention proposes a structure for joining a column and beam frame and a shear wall that reduces breaking of an anchor to enhance a transmission capability of a shear force between a frame and the shear wall by dividing the shear force to a plurality of anchors via a plate from an early stage in which a relative deformation is caused between the frame and the shear wall.

SUMMARY

A structure for joining a column and beam frame and a shear wall according to claim 1 of the invention is a structure for joining a column and beam frame and a shear wall in which a shear wall and a frame are joined using a plurality of anchors. The shear wall is disposed in a structure plane of the frame of a column and a beam of a reinforced concrete structure. The shear wall is a reinforced concrete structure. The plurality of anchors is disposed in a longitudinal direction and a height direction along an outer peripheral surface of the shear wall. One or a plurality of plates is disposed between an inner peripheral surface of the frame and the outer peripheral surface of the shear wall, integrated with any one of the frame and the shear wall, and continuous in each of the longitudinal direction and the height direction of the shear wall. The anchors are dispersedly disposed over a whole length in the longitudinal direction and a whole height in the height direction of the shear wall, and fixed to the frame and the shear wall in a state where the anchors penetrate the plate in a thickness direction and are locked to the plate in an in-plane direction. The anchors each include a lock portion locked to the plate, and the anchor has a cross-sectional area perpendicular to an axis of the anchor at the lock portion larger than cross-sectional areas perpendicular to the axis at other portions of the anchor.

The term "plate integrated with any one of the frame and the shear wall" means that, as illustrated in FIG. 1B and FIG. 3A, anchoring devices 7, such as studs (stud bolts) and anchor bolts, are disposed to protrude on a surface in a side at which a plate 6 is integrated, and as a result of burying the anchoring devices 7 in concrete of the side, the plate 6 is joined to the concrete of a frame 1 or a shear wall 4 in a state where the plate 6 behaves integrally with the frame 1 or the shear wall 4 to be integrated.

The term "one or a plurality of plates is disposed between an inner peripheral surface of the frame and the outer peripheral surface of the shear wall, and continuous in each of the longitudinal direction and the height direction of the shear wall" means that the plates 6 are continuously disposed along a boundary surface between an inner peripheral surface of the frame 1 and an outer peripheral surface of the shear wall 4, and means that a case where one continuous plate 6 is disposed in each direction and a case where a plurality of plates 6 is continuously disposed to be mutually butted in an axial direction are included.

When a plurality of plates 6 is disposed in each direction, since the mutually adjacent plates 6, 6 are mutually butted in the axial direction, it is substantially the same as a state where one continuous plate 6 is disposed. The term "axial direction of the plate" means a direction in which a plurality of plates 6 is arranged, and means a direction perpendicular to a width direction and a thickness direction. The reinforced concrete structures of the frame 1 and the shear wall 4 include a steel reinforced concrete structure.

When a pressure between the plates 6, 6 due to the contact between end portions of the plates 6, 6 in the two directions at a corner of the frame 1 possibly causes a problem in a deformation (inter-story deformation) of the frame 1 mainly in an in-plane direction of the structure plane, it is reasonable to discontinuously dispose the plates 6, 6 in the two directions to avoid generation of an unnecessary stress by the pressure (claim 5). The plates 6, 6 in the two directions are the plate 6 disposed in the longitudinal direction and the plate 6 disposed in the height direction of the shear wall 4.

The term "discontinuously dispose" means that a void (space) is ensured between end portions of the plate 6 in the longitudinal direction and the plate 6 in the height direction of the shear wall 4, and includes a case where an end surface of the plate 6 in any direction abuts on a column 2 or a beam 3. A "void size" is set corresponding to an assumed inter-story deformation angle of the frame 1. The term "void is ensured" also can be referred that the plates 6 are not disposed in sections of parts of the column 2 and the beam 3 including the corner in the inner peripheral surface side of the frame 1.

When the plates in the two directions are continuous at the corner of the frame as disclosed in Patent Literature 4 (paragraph 0031, FIG. 1), the corner between the plates in the two directions, that is, the butted part in the two directions is easily deformed forcibly by the frame in the deformation of the frame, and an excessive compressive stress is generated on the plate, thus possibly deforming the section other than the corner portion.

In contrast, when the plates 6, 6 in the two directions are not continuous at the corner of the frame 1 (claim 5), the forcible deformation when the plates 6 follow the deformation of the frame 1 is reduced or released. Consequently, the following capability to the inter-story deformation angle of the plates 6, 6 in the two directions is enhanced, and fatigue of the plate 6 due to the forcible deformation and breaking caused by the fatigue are easily avoided.

Since the plate 6 is integrated with any one of the frame 1 and the shear wall 4, the plate 6 behaves together with the frame 1 or together with the shear wall 4 in the deformation of the frame 1. When the plate 6 is integrated with the shear wall 4 as illustrated in FIG. 1A and the following drawings, the plate 6 tries to relatively move with respect to the frame 1 in the deformation of the frame 1, and when the plate 6 is integrated with the frame 1, the plate 6 tries to relatively move with respect to the shear wall 4 together with the frame 1 in the deformation of the frame 1. The integration of the plate 6 with the shear wall 4 or the frame 1 is allowed by providing the anchoring device 7 described above, which is fixed in the shear wall 4 or the frame 1, disposed to protrude on any one of both surfaces of the plate 6 as illustrated in, for example, FIG. 3A and FIG. 4.

When the plate 6 is integrated with the shear wall 4, in the deformation of the frame 1, the plate 6 receives a shear force from a lock portion 51 of an anchor 5 via a section buried in the frame 1 of the anchor 5 that behaves together with the frame 1, and transmits the shear force to the shear wall 4 via a section buried in the shear wall 4 of the anchor 5. When the plate 6 is integrated with the frame 1, in the deformation of the frame 1, the plate 6 relatively moves with respect to the shear wall 4 together with the section buried in the frame 1 of the anchor 5, and transmits the shear force to the shear wall 4 via the section buried in the shear wall 4 of the anchor 5.

In a case where the lock portion 51 of the anchor 5 is locked to the plate 6 and locked to any one of the frame 1 and the shear wall 4 (claim 2), for example, as illustrated in FIG. 4, when the plate 6 is integrated with the shear wall 4 by burying the anchoring device 7, and the lock portion 51 is locked to the frame 1 (column 2 and beam 3) while being locked to the plate 6, the shear force from the frame 1 is transmitted to the plate 6 not only from the section buried in the frame 1 of the anchor 5 but also from the lock portion 51 locked to the frame 1. The shear force is transmitted to the shear wall 4 via the plate 6 and the section buried in the shear wall 4 of the anchor 5. When the plate 6 is integrated with the frame 1, and the lock portion 51 is locked to the shear wall 4, the shear force from the frame 1 is transmitted to the shear wall 4 from not only the section buried in the frame 1 of the anchor 5 but also the plate 6 via the lock portion 51 and the section buried in the shear wall 4 of the anchor 5.

In both cases, the portion locked to the frame 1 or the shear wall 4 in the lock portion 51 functions to transmit the shear force between the frame 1 and the shear wall 4. When the lock portion 51 is locked to any one of the frame 1 and the shear wall 4 (claim 2), the lock portion 51 includes a continuously disposed fitting portion 52 inserted into a borehole 1*a* formed in any one of the frame 1 and the shear wall 4 (claim 3). In this case, since the fitting portion 52 is locked to any one of the frame 1 and the shear wall 4 while being locked to the plate 6, the fitting portion 52 provides the function of transmitting the shear force. Thus, in principle, the lock portions 51 (fitting portions 52) share the function of transmitting the shear force between the frame 1 and the shear wall 4 via the plate 6, and the anchoring devices 7 described above share the function of ensuring the integrity between the plate 6 and the concrete.

The term "the anchors are dispersedly arranged over a whole length in the longitudinal direction and a whole height in the height direction of the shear wall" in claim 1 means that the anchors 5 are dispersedly arranged over the whole length in the longitudinal direction and dispersedly arranged over the whole height in the height direction of the shear wall 4. The terms "longitudinal direction of the shear wall" and "height direction of the shear wall" are axial directions of the plates 6. While the term "dispersedly arranged" means an arrangement mainly evenly dispersed in the axial direction of the plate 6, the even dispersion is not necessarily required. The term "dispersion" includes an arrangement in a staggered pattern and an arrangement in a plurality of rows in the width direction of the plate 6.

The terms "whole length" and "whole height" exclude corners of the shear wall 4 when the plates 6 are not disposed at the corners (claim 5). The term "the anchor . . . in a state of penetrating the plate in a thickness direction and being locked to the plate in an in-plane direction" means that no clearance is substantially provided at least in the axial direction of the plate 6 between a peripheral surface of the anchor 5 and an inner peripheral surface of an insertion hole 6*a* of the plate 6 through which the anchor 5 penetrates. The term "at least" means that a case where clearances are allowed in the width direction of the plate 6 is included. The state where the clearances are not provided is obtained by, for example, welding a part (section) penetrating through the insertion hole 6*a* of the anchor 5 around the insertion hole 6*a* and burying the part (section) with a weld metal 61.

Since the shear force is transmitted between the frame 1 and the shear wall 4 via the anchor 5 mainly when the frame 1 deforms in an in-plane direction of the structure plane, the "in-plane direction of the plate" is mainly the axial direction of the plate 6. However, since the frame 1 also deforms in an out-of-plane direction of the structure plane, the "in-plane direction of the plate" includes the width direction of the plate 6, and the anchor 5 is locked also in the width direction of the plate 6 to increase the transmission effect of the shear force. Hereinafter, the deformations of the frame 1 in the in-plane direction of the structure plane and the out-of-plane direction of the structure plane are collectively referred to as a deformation of the frame 1 in the in-plane direction of the structure plane and the like, or simply a deformation.

Since all the anchors 5 arranged in respective directions are dispersedly arranged in the longitudinal direction and the height direction of the shear wall 4 while penetrating the plates 6, the shear force in the in-plane direction of the plate 6 is transmitted to the plates 6 evenly in the axial directions of the plates 6 from the sections buried in the frame 1 of all the anchors 5 when the frame 1 deforms in the in-plane direction of the structure plane and the like. The shear force is transmitted to the shear wall 4 from the plates 6 evenly in the longitudinal direction and the height direction via the sections buried in the shear wall 4 of all the anchors 5, and the shear wall 4 bears a horizontal force causing the deformation of the frame 1. The anchor 5 bears an axial tensile force together with the shear force in the deformation of the frame 1.

In the deformation of the frame 1, since the section buried (fixed) in the frame 1 and the section buried (fixed) in the shear wall 4 of the anchor 5 are restrained by the frame 1 and the shear wall 4, respectively, the axial tensile force acts to the anchor 5, and it is assumed that the respective buried sections are pulled out from the frame 1 and the shear wall 4 depending on the degree of the tensile force. In such a situation, as illustrated in FIG. 3A to FIG. 5, anchor members 53 having cross-sectional areas larger than a cross-sectional area of the anchor 5 excluding the lock portion 51 are coupled or formed at end portions in both sides in the axial direction of the anchor 5, thereby ensuring the safety against the pulling out.

Since the shear force in the in-plane direction of the plate 6 is evenly transmitted to the shear wall 4 via all the anchors 5 in the respective directions, the shear force transmitted from the frame 1 to the shear wall 4 is divided to the respective anchors 5 substantially evenly or in a state close to even. Therefore, the shear force applied to each anchor 5 is reduced, and the possibility of breaking of the anchor 5 is reduced. Especially, since the cross-sectional area perpendicular to the axis of the anchor 5 at the lock portion 51 locked to the plate 6 of the anchor 5 is larger than the cross-sectional area perpendicular to the axis at the other portion of the anchor 5, the safety against the breaking due to the shear force repeatedly applied in the state where the anchor 5 is locked to the plate 6 is high.

Since the clearance is substantially not provided between the anchor 5 and the inner peripheral surface of the insertion hole 6*a* of the plate 6, the shear force is transmitted from the section buried in the frame 1 to the section buried in the shear wall 4 of the anchor 5 from the start of the deformation of the frame 1. Therefore, the shear force can be divided to the plurality of anchors 5 via the plates 6 from the early stage in which the relative deformation occurs.

Additionally, since the shear force in the in-plane direction of the plate 6 is evenly transmitted to the shear wall 4 via all the anchors 5 in the respective directions, a force in the in-plane direction that acts to the plate 6 and is generated by the shear force from the anchor 5 is also dispersed in the axial direction. Therefore, there is no position at which the stress suddenly changes as a case where the force in the in-plane direction is concentrated in a part in the axial direction, thus reducing the breaking of the plate 6 itself.

The cross-sectional area perpendicular to the axis of the anchor 5 at the lock portion 51 locked to the plate 6 of the anchor 5 is larger than the cross-sectional area perpendicular to the axis at the other portion of the anchor 5, and this is simply obtained by making the cross-sectional area including an outer diameter or the like at a part of the section in the intermediate portion in the axial direction of the anchor 5 larger than the cross-sectional area including an outer diameter or the like at other section as illustrated in FIG. 5.

Additionally, as illustrated in FIGS. 3A to 3D and FIG. 4, the cross-sectional area of the lock portion 51 can be made larger than the cross-sectional area of the other portion also by disposing a nut-shaped component as the lock portion 51 of a separate body from the shaft portion 50, which is the main body of the anchor 5, at the intermediate portion in the axial direction of the anchor 5, and integrating the nut-shaped component with the main body (shaft portion 50) of the anchor 5 by screwing or the like (claim 2). The lock portion 51 in this case includes the fitting portion 52 continuously disposed as described above, and the fitting portion 52 is locked to the plate 6 and locked to any one of the frame 1 and the shear wall 4 (claim 2). In this case, the shaft portion 50 of the anchor 5 is screwed with a female screw tapped in an insertion hole 51*a* or inserted through the simple insertion hole 51*a* axially provided to the lock portion 51 as the separate body.

When the lock portion 51 as the separate body is coupled to the shaft portion 50, a part locked to the plate 6 in the lock portion 51 corresponds to the lock portion 51 of claim 1, and a part locked to any one of the frame 1 and the shear wall 4 as the fitting portion 52 is inserted and buried in the concrete of any one of the frame 1 and the shear wall 4. The lock portion 51 in this case has an integrally formed shape in which the fitting portion 52 is continuous with one side in the axial direction of the lock portion 51 as illustrated in FIGS. 3A to 3D and FIG. 4. The fitting portion 52 is fitted in the borehole 1*a* or the space formed in the concrete of any one of the frame 1 and the shear wall 4, and buried in a curable filler 8, such as mortar and an adhesive agent, filled in the borehole 1*a* or the like. The borehole 1*a* is a hole formed in an existing building frame, and the space means a space ensured in a newly built building frame.

As described above, the lock portion 51 (fitting portion 52) provides the function of transmitting the shear force between the frame 1 and the shear wall 4 via the plate 6. Therefore, when the lock portion 51 (fitting portion 52) is locked to the frame 1 (column 2 and beam 3) as illustrated in FIGS. 3A to 3D and FIG. 4, the shear force from the frame 1 can be received from not only the section buried in the frame 1 of the anchor 5 (shaft portion 50) but also the fitting portion 52, and the shear force from the frame 1 is transmitted to the plate 6 via the lock portion 51. In this case, since the shear force is transmitted to the shear wall 4 from the plate 6, it is reasonable to integrate the plate 6 with the shear wall 4. Therefore, when the anchoring device 7 is disposed to protrude on the plate 6, the anchoring device 7 is basically disposed to protrude on the shear wall 4 side of the plate 6 as illustrated in FIG. 1B and FIG. 4.

When the fitting portion 52 of the lock portion 51 is locked to the shear wall 4, the fitting portion 52 can transmit the shear force from the plate 6 to not only the section buried in the shear wall 4 of the anchor 5 (shaft portion 50) but also the shear wall 4. Therefore, the anchoring device 7 disposed to protrude on the plate 6 is disposed to protrude mainly on the frame 1 side of the plate 6 in a manner of turning the anchoring device 7 disposed in the lower side in FIG. 1B upside down, and the plate 6 is integrated with the frame 1.

When the fitting portion 52 is formed to be continuous with the lock portion 51 (claims 2, 3), and the fitting portion 52 is buried in the borehole 1*a*, the borehole 1*a* is formed in any one of the frame 1 and the shear wall 4 from the plate 6 side, and the fitting hole 1*b* that the outer peripheral surface of the fitting portion 52 can contact (internally contact) is continuously provided to the plate 6 side of the borehole 1*a* (claim 3). The term "can contact" means that a case where the whole outer peripheral surface of the fitting portion 52 is substantially in contact (in close contact) with the inner peripheral surface of the fitting hole 1*b* as illustrated in FIG. 3D and a case of not being in contact as illustrated in FIG. 3C are included, and means that a case where a slight void is present between the outer peripheral surface of the fitting portion 52 and the inner peripheral surface of the fitting hole 1*b* is included. A "direction in which the outer peripheral surface of the fitting portion 52 contacts" is a direction perpendicular to the axial direction of the anchor 5.

In this case, when the inner peripheral surface of the fitting portion 52 is not in external contact with the shaft portion 50 as the main body of the anchor 5 as illustrated in FIG. 3C, by continuously forming the fitting hole 1*b* having the plane area larger than that of the borehole 1*a* in the plate 6 side of the borehole 1*a* such that the outer peripheral surface of the fitting portion 52 can contact the inner peripheral surface of the fitting hole 1*b* (claim 3), a certain bonding strength with the filler 8 is ensured over the whole length of the section buried in the filler 8 of the shaft portion 50 inserted into the borehole 1*a* including the fitting hole 1*b*.

The term "fitting hole 1*b* having the plane area larger than that of the borehole 1*a*" means that a plane area A2 perpendicular to the axial direction of the inner peripheral surface of the fitting hole 1*b* is larger than a plane area A1 perpendicular to the axial direction of the inner peripheral surface of the borehole 1*a* (A2>A1). The plane area A2 of the inner peripheral surface of the fitting hole 1*b* is larger than the plane area A1 of the inner peripheral surface of the borehole 1*a* (A2>A1), and this also means that an inner diameter of the fitting hole 1*b* is larger than an inner diameter of the borehole 1*a* when the inner peripheral surface of the fitting hole 1*b* and the inner peripheral surface of the borehole 1*a* both have a circular shape.

When the anchor is inserted into the borehole of the concrete and fixed by filling the filler in the borehole, assume that the inner peripheral surface of the fitting portion (inserted portion) is not in external contact with the anchor main body (shaft portion) as, for example, Japanese Patents No. 5331268 and No. 5978363. When the plane area of the borehole is axially uniform like these, the volume of the filler filled around the section close to the inserted portion of the section buried in the concrete of the anchor is reduced by the amount of the volume of the inserted portion when the inserted portion is fitted to the borehole. In the present disclosure, the amount per unit length of the shaft portion 50 of the filler 8 around the shaft portion 50 in the section of the fitting hole 1*b* is smaller than the amount of the filler 8 around the shaft portion 50 in the section of the borehole 1*a* excluding the fitting hole 1*b*. Consequently, the bonding strength with the filler is reduced in the section, and the stability against the pulling out of the shaft portion 50 is possibly reduced.

When the bonding strength with the filler 8 in the section buried in the concrete of the shaft portion 50 of the anchor 5 is not axially constant (uniform), the section close to the lock portion 51 at which the bonding strength is small is possibly peeled off from the filler 8. When the peeling off occurs in the section close to the lock portion 51 of the shaft portion 50, the shaft portion 50 resists the tensile force with the bonding strength of only the other portion. However, since the portion continuous with the peeled off section becomes to be easily linked, it is difficult to ensure a situation where the whole length of the buried section of the shaft portion 50 continues to evenly resist the tensile force.

In contrast, since the plane area A2 of the fitting hole 1*b* is larger than the plane area A1 of the borehole 1*a* (A2>A1) as illustrated in FIG. 3C, a state where the amount of the filler 8 around the shaft portion 50 in the section of the fitting hole 1*b* does not become extremely smaller than the amount of the filler 8 around the shaft portion 50 in the section of the borehole 1*a* excluding the fitting hole 1*b* can be obtained. That is, a situation where the peripheral area of the shaft portion 50 is surrounded by the filler 8 by approximately the same amount per unit length over the whole length of the section buried in the concrete of the shaft portion 50 regardless of the insertion of the fitting portion 52 into the fitting hole 1*b* can be obtained. Consequently, the bonding strength of a certain degree or more is obtained over the whole length of the shaft portion 50 inserted into the borehole 1*a* including the fitting hole 1*b*, thus improving the stability against the pulling out of the shaft portion 50.

Especially, when a plane area A3 perpendicular to the axial direction of the inner peripheral surface of the fitting portion 52 when the fitting portion 52 is inserted into the fitting hole 1*b* is equal to or more than the plane area A1 perpendicular to the axial direction of the inner peripheral surface of the borehole 1*a* (A3>A1) (claim 4) as illustrated in FIG. 3D, a situation where the peripheral area of the shaft portion 50 is surrounded by the filler 8 by the same amount or more per unit length over the whole length of the section buried in the concrete of the shaft portion 50 regardless of the insertion of the fitting portion 52 into the fitting hole 1*b* can be obtained, thus more improving the stability against the pulling out. The plane area A3 of the inner peripheral surface of the fitting portion 52 is equal to or more than the plane area A1 of the inner peripheral surface of the borehole 1*a*, and this also can be said that the inner diameter of the fitting portion 52 is equal to or more than the inner diameter of the borehole 1*a* when the inner peripheral surface of the fitting portion 52 and the inner peripheral surface of the borehole 1*a* have a circular shape. In FIGS. 3C and 3D, a backing metal 62 illustrated in FIG. 3A is omitted.

Since the plane area A3 perpendicular to the axial direction of the inner peripheral surface of the fitting portion 52 when the fitting portion 52 is inserted into the fitting hole 1*b* is equal to or more than the plane area A1 perpendicular to the axial direction of the borehole 1*a* (A3>A1), the plane area A2 perpendicular to the axial direction of the inner peripheral surface of the fitting hole 1*b* is larger than the plane area A1 perpendicular to the axial direction of the borehole 1*a* (A2>A1).

Consequently, the constant (uniform) bonding strength is ensured over the whole length of the section buried in the concrete (filler 8) of the shaft portion 50 of the anchor 5, and an advantage that the bonding strength of the whole length of the buried section can resist the tensile force is provided. When the cross-sectional shapes of the fitting hole 1*b* and the borehole 1*a* both have a circular shape as illustrated in FIG. 3B, it is only necessary that the inner diameter of the fitting hole 1*b* has a size such that the inner diameter of the fitting portion 52 when the fitting portion 52 is in internal contact with the inner peripheral surface of the fitting hole 1*b* is equal to or more than the inner diameter of the borehole 1*a*.

When the inner peripheral surface of the fitting portion 52 is in external contact with the shaft portion 50, since the filler 8 is filled around a section exposed from the fitting portion 52 of the shaft portion 50, the bonding strength with the filler 8 in a part of the section of the shaft portion 50 exposed from the fitting portion 52 does not become lower than the bonding strength in the other section.

The plates integrated with any one of the frame and the shear wall are continuously disposed between the frame and the shear wall in the longitudinal direction and the height direction, and the anchors are dispersedly disposed in the longitudinal direction and the height direction of the shear wall and fixed to the frame and the shear wall in the state of being locked to the plates in the in-plane direction while penetrating the plates in the thickness direction. Therefore, when the frame deforms in the in-plane direction of the structure plane and the like, the shear force in the in-plane direction of the plates can be transmitted from the sections buried in the frame of all the anchors to the plates evenly in the axial direction of the plate. Since the shear force can be transmitted from the plates via the sections buried in the shear wall of all the anchors evenly in the longitudinal direction and the height direction of the shear wall, the shear wall can bear the horizontal force causing the deformation of the frame.

Since the shear force in the in-plane direction of the plate is evenly transmitted to the shear wall via all the anchors in the respective directions, the shear force transmitted from the frame to the shear wall can be substantially evenly divided to each of the anchors. Therefore, the shear force applied to each anchor is reduced, and the possibility of breaking of the anchor is reduced. Especially, since the cross-sectional area perpendicular to the axis of the anchor at the lock portion to the plate of the anchor is larger than the cross-sectional area perpendicular to the axis at the other portion of the anchor, the safety against the breaking due to the shear force repeatedly applied in the state where the anchor is locked to the plate is high.

Since the clearance is not provided between the anchor and the inner peripheral surface of the insertion hole, the shear force can be transmitted from the section buried in the frame to the section buried in the shear wall of the anchor from the start of the deformation of the frame. Therefore, a state where the shear force can be divided to the plurality of anchors via the plates from the early stage in which the relative deformation occurs can be obtained. Additionally, since the shear force in the in-plane direction of the plate is evenly transmitted to the shear wall via all the anchors in the respective directions, a force in the in-plane direction that acts to the plate and is generated by the shear force from the anchor is also dispersed in the axial direction. Therefore, a position at which the stress suddenly changes as a case where the force in the in-plane direction is concentrated in a part in the axial direction is not generated, thus reducing the breaking of the plate itself.

DETAILED DESCRIPTION

Figure 1A:
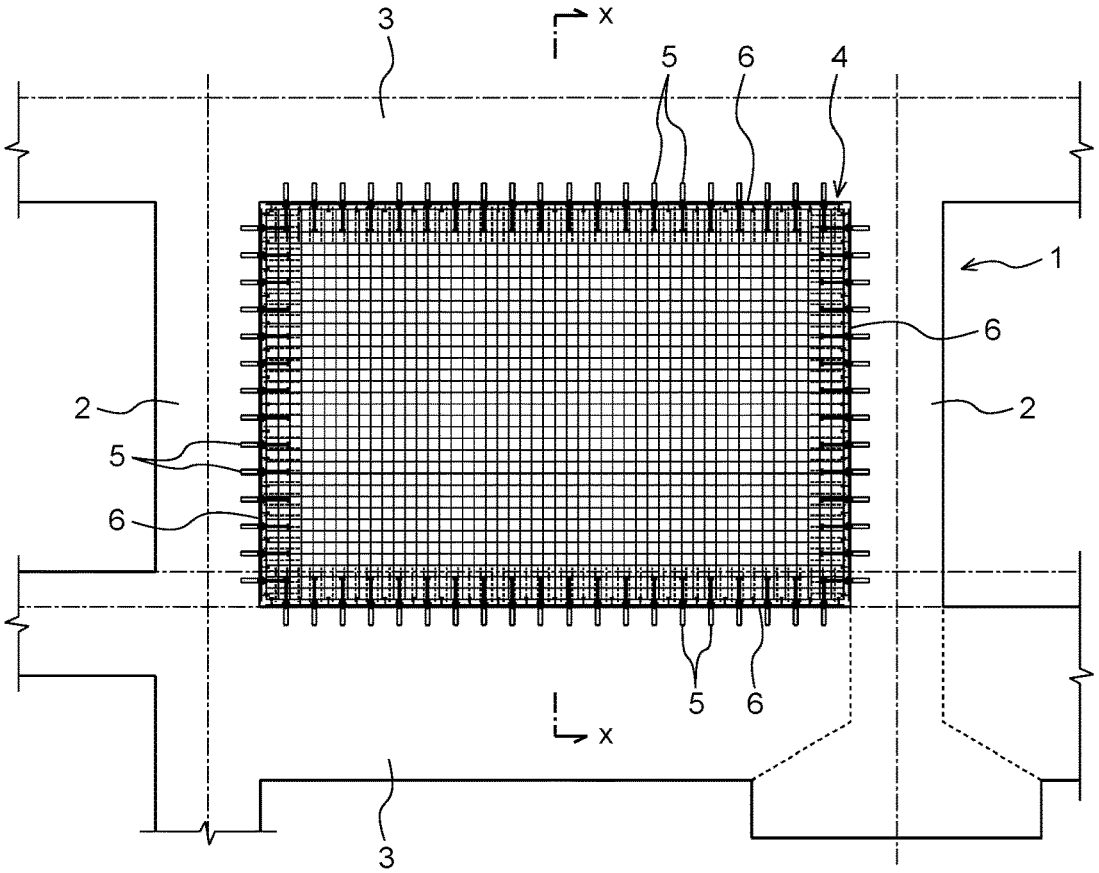
FIG. 1A is an elevational view illustrating a state where a frame of a column and a beam is joined with a shear wall using plates and anchors.
Figure 1B:
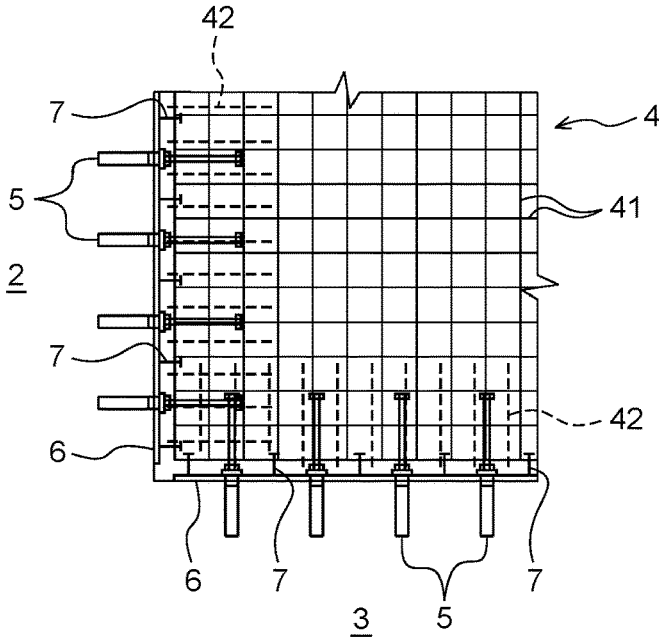
FIG. 1B is a partially enlarged view of FIG. 1A.

FIGS. 1A and 1B illustrate a specific example of a joining structure in which a shear wall 4 of a reinforced concrete structure is joined to a frame 1 using a plurality of anchors 5, the shear wall 4 is disposed in a structure plane of the frame 1 including a column 2 and a beam 3 of a reinforced concrete structure, and the plurality of anchors 5 is arranged in a longitudinal direction (horizontal direction) and a height direction (vertical direction) along an outer peripheral surface of the shear wall 4. The frame 1 may be an existing structure, or may be newly built together with the shear wall 4. The shear wall 4 is also an existing structure in some cases.

One or a plurality of plates (steel plates) 6 is disposed between an inner peripheral surface of the frame 1 and an outer peripheral surface of the shear wall 4. The plates (steel plates) 6 are integrated with any one of the frame 1 and the shear wall 4, and continuous in each of the longitudinal direction and the height direction of the shear wall 4. The plate 6 is disposed to be continuous including corners along a peripheral area of the shear wall 4 in some cases. However, to avoid a forcible deformation of the plate 6 positioned at the corner of the frame 1 when the frame 1 deforms in an in-plane direction of a structure plane and the like, it is appropriate that the plate 6 disposed in the longitudinal direction of the shear wall 4 is discontinuous with the plate 6 disposed in the height direction of the shear wall 4 at the corner of the frame 1 as illustrated in FIG. 1B (claim 4).

When the plates 6, 6 are discontinuous at the corner of the frame 1, a distance between the end portions of the plates 6, 6 in the two directions has any magnitude. In FIGS. 1A and 1B, an end portion in an axial direction of the plate 6 in the horizontal direction is apart from a surface in the shear wall 4 side of the column 2, and an end portion in an axial direction of the plate 6 in the vertical direction is apart from a surface in the shear wall 4 side of the beam 3. However, any one of the end portions is brought into contact with the inner peripheral surface of the frame 1 in some cases.

When the plurality of plates 6 is continuously disposed in the axial direction along the peripheral area of the shear wall 4, end surfaces in the axial direction of the mutually adjacent plates 6, 6 are mutually butted to be engaged in the axial direction. However, the plates 6, 6 are mutually engaged in a width direction to ensure a stability against deviation (relative movement) in the width direction in some cases.

The plate 6 includes anchoring devices 7, such as studs, disposed to protrude on any of both surfaces in a thickness direction, that is, any of a surface in the frame 1 side and a surface in the shear wall 4 side, and the anchoring devices 7 are buried in concrete of the frame 1 or the shear wall 4, thereby integrating the plate 6 with the frame 1 or the shear wall 4. The anchoring devices 7 are disposed to protrude at portions excluding the positions at which the anchors 5 penetrating the plates 6 are disposed. The anchoring device 7 may have any shape and any configuration.

Figure 2A:
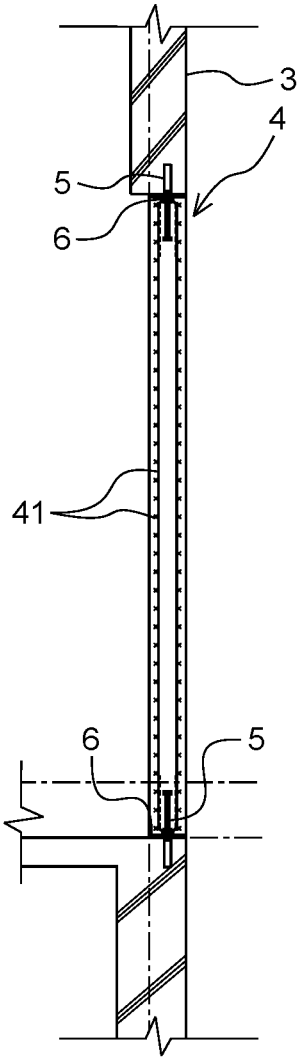
FIG. 2A is a cross-sectional view taken along a line x-x of FIG. 1A.
Figure 2B:
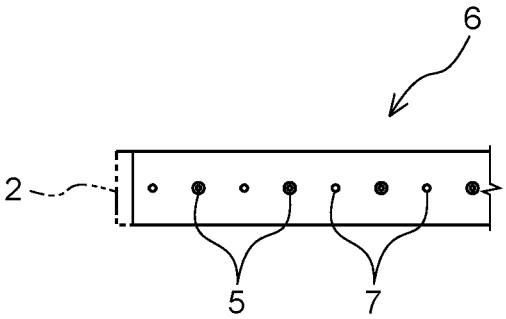
FIG. 2B is a plan view of a part of the plate disposed on an upper surface of the beam in a lower floor side in FIG. 1A.

FIG. 2B illustrates a planar surface of the plate 6 at a portion close to the column 2 of the beam 3 in a lower floor of FIG. 1A. Here, while the anchors 5 and the anchoring devices 7 are arranged at constant intervals in the axial direction of the plate 6, the anchors 5 and the anchoring devices 7 may be arranged in any state, and the anchors 5 and the anchoring devices 7 are both arranged in the width direction of the plate 6 in one case, or are arranged in a staggered pattern in another case.

The anchors 5 penetrate the plates 6 in the thickness directions, dispersedly disposed over the whole length in the longitudinal direction and the whole height in the height direction of the shear wall 4 in the state of being locked to the plates 6 in the in-plane direction, and fixed to the frame 1 and the shear wall 4. As illustrated in FIG. 3A to FIG. 5, the anchor 5 includes a lock portion 51 locked to the plate 6, and the lock portion 51 has a cross-sectional area perpendicular to an axis of the anchor 5 larger than cross-sectional areas perpendicular to the axis at the other portions of the anchor 5.

The lock portion 51 of the anchor 5 is inserted through an insertion hole 6*a* provided to the plate 6, and directly locked to an inner peripheral surface of the insertion hole 6*a*, or indirectly locked to the inner peripheral surface of the insertion hole 6*a* via a weld metal 61 welded around the lock portion 51 to integrate the lock portion 51 with the insertion hole 6*a* as illustrated in FIGS. 3A to 3D. The lock portion 51 is locked to the inner peripheral surface of the insertion hole 6*a* in the axial direction or in the axial direction and the width direction of the plate 6.

FIG. 1A and the following drawings illustrate an example in which tubular boreholes 1*a* are drilled in the concrete of the frame 1 from the inner peripheral surface (shear wall 4) side of the frame 1, and the plates 6 are disposed along the inner peripheral surface of the frame 1 when the frame 1 is an existing structure. The center of the insertion hole 6*a* of the plate 6 is matched with the center of the borehole 1*a*. The lock portion 51 is inserted into the insertion hole 6*a* of the plate 6, and the peripheral area of the lock portion 51 is welded, thereby filling a void between the inner peripheral surface of the insertion hole 6*a* and the lock portion 51.

In this case, a backing metal 62 is disposed around the insertion hole 6*a* on the frame 1 side (back surface side) of the plate 6, and a void provided to the back surface of the plate 6 for disposing the backing metal 62 is filled with a filler 8, such as mortar and an adhesive agent, for the stability of the plate 6 at normal times. A depressed portion to which the backing metal 62 is inserted is provided to the back surface of the plate 6 in some cases. FIG. 1A and the following drawings illustrate an example in which the shear wall 4 is newly built, and a section buried in the shear wall 4 of the anchor 5 is simply arranged in a space ensured in the shear wall 4 to be built. This space is ensured so as not to be interfered by main reinforcements 41, shear reinforcements, anchor reinforcements 42, and the like in two directions in the shear wall 4.

When the frame 1 is deformed, a shear force is transmitted to the plate 6 from the section buried in the frame 1 of the anchor 5 and the lock portion 51 locked to the plate 6. Here, especially when the lock portion 51 is welded to be integrated with the plate 6, the void between the lock portion 51 and the inner peripheral surface of the insertion hole 6*a* is completely filled. Therefore, plasticization hardly occurs due to reaction forces from the plate 6, which are alternately received by the lock portion 51 in positive and negative directions, when the shear force is transmitted to the shear wall 4 from the section buried in the shear wall 4 of the anchor 5 and the plate 6.

Figure 5:
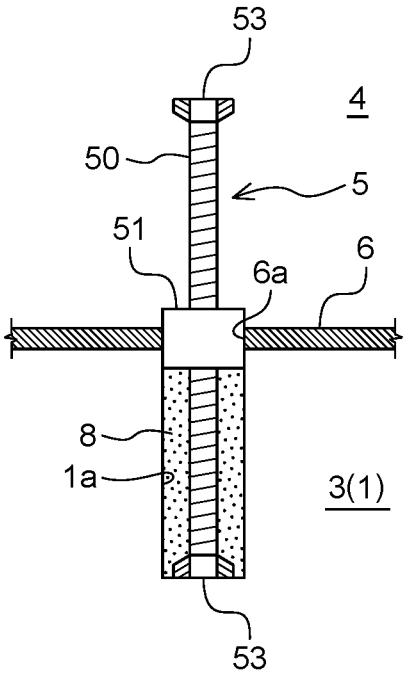
FIG. 5 is an elevational view illustrating a manufacturing example of the anchor when a lock portion is integrally formed with an anchor main body.

Hereinafter, a main body of the anchor 5 is referred to as a shaft portion 50 for convenience. When the anchor 5 has a configuration as illustrated in FIG. 5, a section excluding anchor members 53 described below is the shaft portion 50. In the configuration illustrated in FIGS. 3A to 3D and FIG. 4, actually, a section that projects to the frame 1 side and the shear wall 4 side from the insertion hole 6*a* of the plate 6 and is buried and fixed in the frame 1 and the shear wall 4 is the shaft portion 50.

Figure 3A:
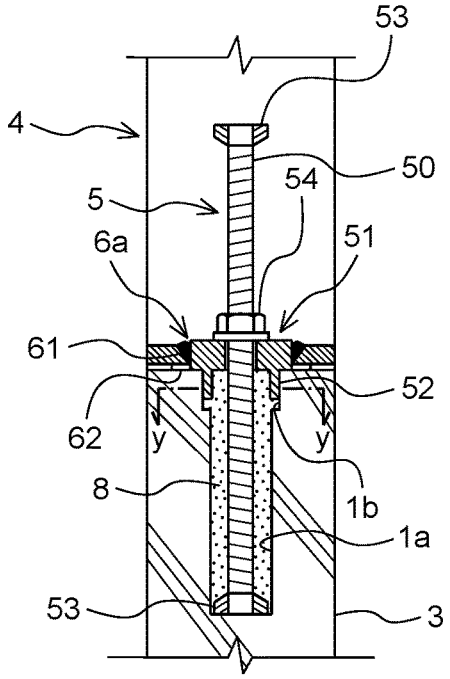
FIG. 3A is a partially enlarged view of FIG. 2A illustrating the anchor and the plate between the shear wall and the beam in the lower floor side of FIG. 1A in detail.
Figure 3B:
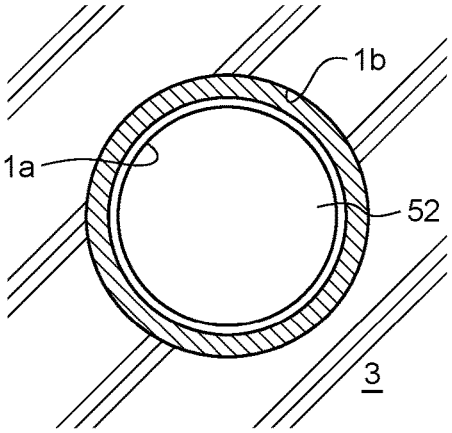
FIG. 3B is a cross-sectional view taken along a line y-y of FIG. 3A.

As illustrated in FIG. 3A, ribs in any shape are formed by tapping a male screw, knotting, or the like in the section buried in the frame 1 and the section buried in the shear wall 4 of the shaft portion 50 to ensure a bonding strength with the filler 8 filled in the borehole 1*a* and a bonding strength with the concrete. When male screws are formed at the section buried in the frame 1 and the section buried in the shear wall 4 of the shaft portion 50, the lock portion 51 is tightened to the plate 6 with a nut 54 from the shear wall 4 side as the newly built side, thereby enhancing the integrity of the anchor 5 and the plate 6.

While the lock portion 51 is integrally formed as a part of the shaft portion 50 in the intermediate portion in the axial direction of the main body of the anchor 5 as illustrated in FIG. 5, the lock portion 51 is formed by coupling a tubular component as a separate body from the shaft portion 50 as illustrated in FIGS. 3A to 3D in some cases. In the case of the separate body, the lock portion 51 includes a fitting portion 52 that is formed to be continuous with the lock portion 51, inserted through the plate 6 to be fitted into any one of the frame 1 and the shear wall 4, and locked to any of the frame 1 and the shear wall 4. While FIG. 1A and the following drawings illustrate an example in which the fitting portion 52 is inserted into the tubular borehole 1*a* or space formed in the concrete of the frame 1, the fitting portion 52 is inserted into the concrete of the shear wall 4 in some cases. The borehole 1*a* is formed in the existing building frame, and the space is ensured in the newly built building frame.

The borehole 1*a* or the space is formed so as to have a depth corresponding to the section buried in the frame 1 or the shear wall 4 of the anchor 5 (shaft portion 50). A plane area in a direction perpendicular to the axial direction of the inner peripheral surface including an inner diameter of the borehole 1*a* or the like only needs to have a size enough to ensure a sufficient bonding strength with the shaft portion 50 when the filler 8, such as mortar, and the concrete are filled in the peripheral area of the shaft portion 50 excluding the lock portion 51. While the "plane area in the direction perpendicular to the axial direction of the inner peripheral surface" is obtained from the inner diameter when the borehole 1*a* and the like have circular cross-sectional surfaces, the borehole 1*a* and the like have cross-sectional shapes other than the circular shape in some cases.

In FIGS. 3A to 3D, when the frame 1 is an existing structure, and the fitting portion 52 is formed to be continuous with the lock portion 51, the borehole 1*a* into which the shaft portion 50 is inserted is provided to the frame 1 (column 2 and beam 3) from the plate 6 side, and a fitting hole 1*b* that the outer peripheral surface of the fitting portion 52 can contact is provided to the plate 6 side of the borehole 1*a*.

Figure 3C:
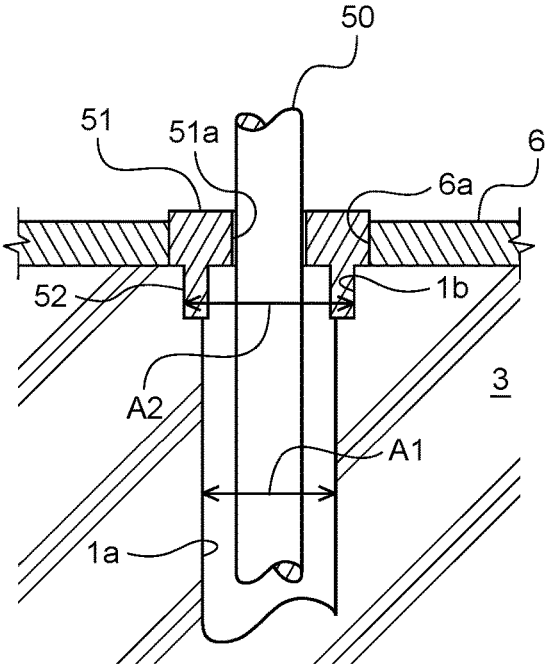
FIG. 3C is an enlarged view of FIG. 3A illustrating a relation between plane areas when a fitting hole having a plane area larger than a plane area of a borehole is continuously formed in a side close to the plate of the borehole.

In this case, to ensure a certain stability against pulling out of the shaft portion 50 from the filler 8 in the section of the fitting portion 52, in FIG. 3C, the inner peripheral surface perpendicular to the axial direction including the inner diameter or the like of the fitting hole 1*b* has a plane area A2 larger than a plane area A1 of the inner peripheral surface perpendicular to the axial direction including the inner diameter or the like of the borehole 1*a*. Since the plane area A2 of the fitting hole 1*b* is larger than the plane area A1 of the borehole 1*a* (A2>A1), a situation where the peripheral area of the shaft portion 50 is surrounded by the filler 8 by approximately the same amount per unit length over the whole length of the section buried in the concrete (filler 8) of the shaft portion 50 regardless of the insertion of the fitting portion 52 into the fitting hole 1*b* can be obtained, thereby ensuring the stability against the pulling out of the shaft portion 50 of a certain degree or more.

Figure 3D:
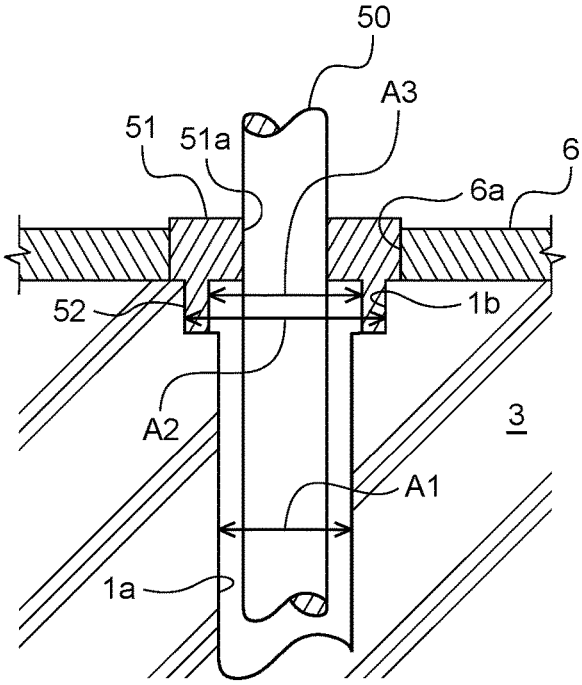
FIG. 3D is an enlarged view of FIG. 3A illustrating a relation between the plane areas when the plane area of the fitting portion is equal to or more than the plane area of the borehole.
Figure 4:
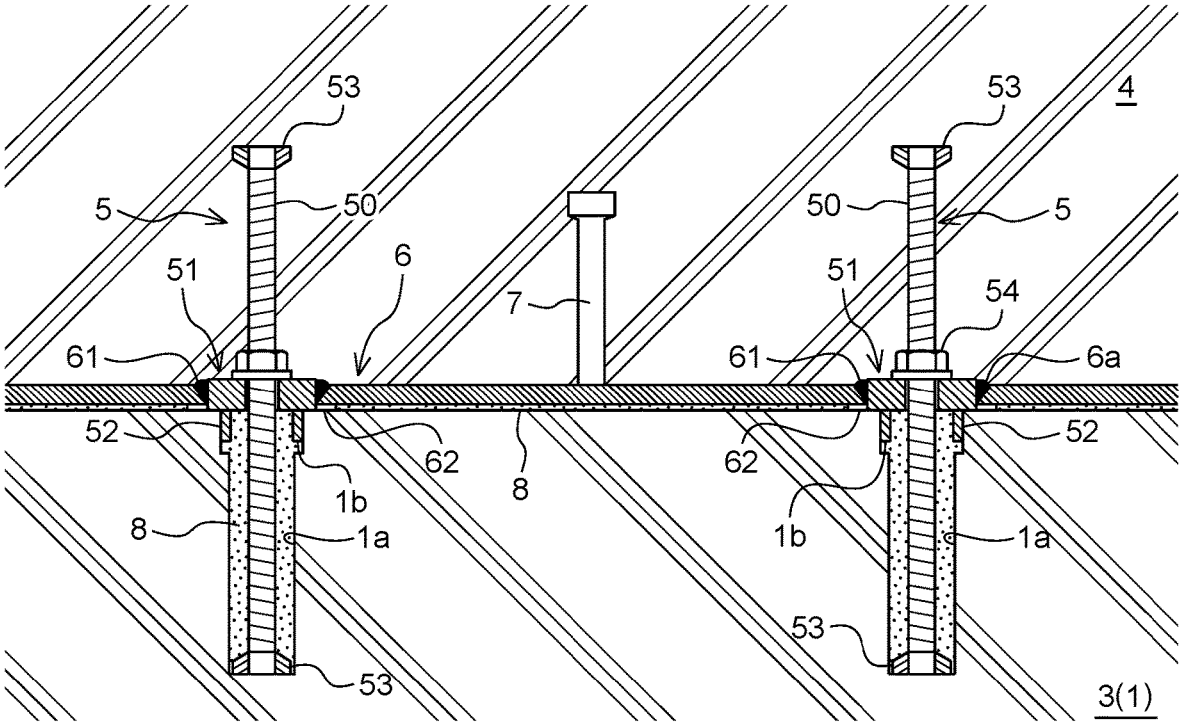
FIG. 4 is a cross-sectional view of FIG. 3A in a perpendicular direction.

FIG. 3D especially illustrates an example in which the inner peripheral surface perpendicular to the axial direction including the inner diameter or the like of the fitting portion 52 has a plane area A3 equal to or larger than the plane area A1 of the inner peripheral surface perpendicular to the axial direction including the inner diameter or the like of the borehole 1*a*. In this case, since the plane area A3 perpendicular to the axial direction of the inner peripheral surface of the fitting portion 52 is equal to or larger than the plane area A1 perpendicular to the axial direction of the inner peripheral surface of the borehole 1*a* (A3>A1), a situation where the peripheral area of the shaft portion 50 is surrounded by the filler 8 by the same amount or more per unit length over the whole length of the section buried in the concrete of the shaft portion 50 compared with the case of A3<A1 can be obtained, thus more improving the stability against the pulling out.

Additionally, in the case of FIG. 3D, with the plane area A3 of the inner peripheral surface of the fitting portion 52 equal to or larger than the plane area A1 of the inner peripheral surface of the borehole 1*a* (A3>A1), a projected area of the fitting portion 52 in a shear force acting direction is enlarged compared with the case of A3<A1, thus enhancing the shear force transmission effect by the enlarged amount. In this case, since the fitting portion 52 has a thickness, the plane area A2 perpendicular to the axial direction of the inner peripheral surface of the fitting hole 1*b* is larger than the plane area A1 perpendicular to the axial direction of the inner peripheral surface of the borehole 1*a* (A2>A1).

When the fitting hole 1*b* having the plane area A2 larger than the plane area A1 of the inner peripheral surface of the borehole 1*a* is not provided, and the plane area A1 of the borehole 1*a* is axially constant, the filler 8 filled in the peripheral area of the section close to the fitting portion 52 in the section buried in the frame 1 (concrete) of the shaft portion 50 is reduced in volume by the volume of the fitting portion 52 when the fitting portion 52 is fitted in the borehole 1*a*. Therefore, the bonding strength with the filler 8 is possibly reduced in the section. When the bonding strength with the filler 8 in the section buried in the frame 1 is not constant (uniform), a part with the low bonding strength is peeled off from the filler 8, and a situation of resisting the tensile force by the bonding strength of only the other parts possibly occurs.

In contrast, by providing the fitting hole 1*b* having the plane area A2 in the side close to the plate 6 of the borehole 1*a* such that the plane area A3 perpendicular to the axial direction of the inner peripheral surface of the fitting portion 52 is equal to or larger than the plane area A1 perpendicular to the axial direction of the inner peripheral surface of the borehole 1*a*, the peripheral area of the shaft portion 50 can be surrounded by the filler 8 by the same amount over the whole length of the section buried in the frame 1 of the shaft portion 50 regardless of the insertion of the fitting portion 52 into the fitting hole 1*b*. Therefore, the constant bonding strength is ensured over the whole length of the section buried in the frame 1, and an advantage of resisting the tensile force by the bonding strength over the whole length of the buried section is provided.

Since the tensile force in the axial direction acts over the whole length of the anchor 5 when the frame 1 is deformed (relatively deformed to the shear wall 4), to ensure the safety against pulling out due to the tensile force, anchor members 53, 53 fixed in the concrete are integrally disposed or coupled by screwing or the like at both end portions in the axial direction of the shaft portion 50.

FIG. 5 illustrates a manufacturing example of the anchor 5 with a simple configuration in which the lock portion 51 is integrally formed at the intermediate portion in the axial direction of the shaft portion 50, and an example of burying the anchor 5 in the frame 1 and the shear wall 4. In this example, since the lock portion 51 is inserted through the insertion hole 6*a* of the plate 6, and inserted into the frame 1 and the shear wall 4, it can be said that the lock portion 51 doubles as the fitting portion 52 in the example illustrated in FIGS. 3A to 3D.

DESCRIPTION OF REFERENCE SIGNS

1 Frame
1*a* Borehole
1*b* Fitting hole
2 Column
3 Beam
4 Shear wall
41 Main reinforcement
42 Anchor reinforcement
5 Anchor
50 Shaft portion

51 Lock portion
52 Fitting portion
53 Anchor member
54 Nut
6 Plate
6*a* Insertion hole
61 Weld metal
62 Backing metal
7 Anchoring device (stud)
8 Filler

What is claimed is:

1. A structure for joining a column and beam frame and a shear wall in which a shear wall and a frame are joined using a plurality of anchors, the shear wall being disposed in a structure plane of the frame of a column and a beam of a reinforced concrete structure, the shear wall being a reinforced concrete structure, the plurality of anchors being disposed in a longitudinal direction and a height direction along an outer peripheral surface of the shear wall, wherein one or a plurality of plates is disposed between an inner peripheral surface of the frame and the outer peripheral surface of the shear wall, integrated with any one of the frame and the shear wall, and continuous in each of the longitudinal direction and the height direction of the shear wall, the plurality of anchors are dispersedly disposed over a whole length in the longitudinal direction and a whole height in the height direction of the shear wall, and fixed to the frame and the shear wall in a state where the anchors penetrate the plate in a thickness direction and are locked to the plate in an in-plane direction, and the plurality of anchors each include a lock portion locked to the plate, and the anchor has a cross-sectional area perpendicular to an axis of the anchor at the lock portion larger than cross-sectional areas perpendicular to the axis at other portions of the anchor.

2. The structure for joining a column and beam frame and a shear wall according to claim 1, wherein the lock portion of an anchor among the plurality of anchors is locked to any one of the frame and the shear wall together with the plate.

3. The structure for joining a column and beam frame and a shear wall according to claim 2, wherein a borehole is formed in any one of the frame and the shear wall from the plate side, a fitting portion that is inserted into the borehole and locked in the in-plane direction of the plate is formed to be continuous with the lock portion, and a fitting hole is formed to the plate side of the borehole, and the fitting hole is contactable with an outer peripheral surface of the fitting portion, and an inner peripheral surface of the fitting hole has a plane area perpendicular to an axial direction larger than a plane area perpendicular to the axial direction of an inner peripheral surface of the borehole.

4. The structure for joining a column and beam frame and a shear wall according to claim 3, wherein the plane area perpendicular to the axial direction of the inner peripheral surface of the fitting portion when the fitting portion is inserted into the fitting hole is equal to or larger than the plane area perpendicular to the axial direction of the inner peripheral surface of the borehole.

5. The structure for joining a column and beam frame and a shear wall according to claim 1, wherein the plate disposed in the longitudinal direction of the shear wall is discontinuous with the plate disposed in the height direction of the shear wall at a corner of the frame.

6. The structure for joining a column and beam frame and a shear wall according to claim 2, wherein the plate disposed in the longitudinal direction of the shear wall is discontinuous with the plate disposed in the height direction of the shear wall at a corner of the frame.

* * * * *